US007994916B2

(12) United States Patent
Kron et al.

(10) Patent No.: US 7,994,916 B2
(45) Date of Patent: Aug. 9, 2011

(54) MICROPROCESSOR CONTROLLED SECURITY TAG

(75) Inventors: Gregory Kron, New Berlin, WI (US); Richard E. Halbach, Alpharetta, GA (US); James Stoffer, Delafield, WI (US); Mark J. Kieckhefer, Waukesha, WI (US)

(73) Assignee: Innovative Control Systems, Inc., Franklin, WI (US)

( * ) Notice: Subject to any disclaimer, the term of this patent is extended or adjusted under 35 U.S.C. 154(b) by 1274 days.

(21) Appl. No.: 11/519,755

(22) Filed: Sep. 11, 2006

(65) Prior Publication Data

US 2007/0008137 A1 Jan. 11, 2007

Related U.S. Application Data

(62) Division of application No. 10/456,333, filed on Jun. 6, 2003, now Pat. No. 7,132,944.

(51) Int. Cl.
*G08B 13/14* (2006.01)

(52) U.S. Cl. ..... 340/572.1; 340/572.4; 340/572.7; 340/10.4; 340/5.6; 235/375; 235/382; 235/385; 235/492

(58) Field of Classification Search ..... 340/572.1, 340/572.4, 572.7, 572.8, 10.4, 56; 235/375, 235/382, 385, 492

See application file for complete search history.

(56) References Cited

U.S. PATENT DOCUMENTS

| | | | | |
|---|---|---|---|---|
| 4,885,571 | A | 12/1989 | Pauley et al. | |
| 4,918,432 | A | 4/1990 | Pauley | |
| 4,952,913 | A | 8/1990 | Pauley et al. | |
| 5,075,670 | A | 12/1991 | Bower et al. | |
| 5,512,879 | A | 4/1996 | Stokes | |
| 5,541,580 | A | 7/1996 | Gerston et al. | |
| 6,084,513 | A | 7/2000 | Stoffer | |
| 6,144,303 | A | 11/2000 | Federman | |
| 7,132,944 | B1 | 11/2006 | Kron et al. | |
| 7,527,198 | B2 * | 5/2009 | Salim et al. | 235/385 |
| 2005/0219053 | A1 * | 10/2005 | Clifford et al. | 340/572.4 |

* cited by examiner

*Primary Examiner* — Tai T Nguyen
(74) *Attorney, Agent, or Firm* — Woodcock Washburn LLP

(57) ABSTRACT

A microprocessor controlled security tag and accompanying security system is described. The tag generally includes a housing having external contacts to interface with elongated contacts on a connecting band. The band forms a complex impedance circuit with a patient's limb that allows detection features such as removal and band compromise. A microprocessor and related circuitry as well as a transmitter and receivers are enclosed in the housing. The tag is adapted to communicate inductively with an activator/deactivator unit as well as a tag programmer that updates and changes tag features in the tag firmware. The overall system further includes a hub to receive the data from a plurality of tags in the system. The tag can also communicate with a phased multiple antenna that sends signals to the tag.

29 Claims, 8 Drawing Sheets

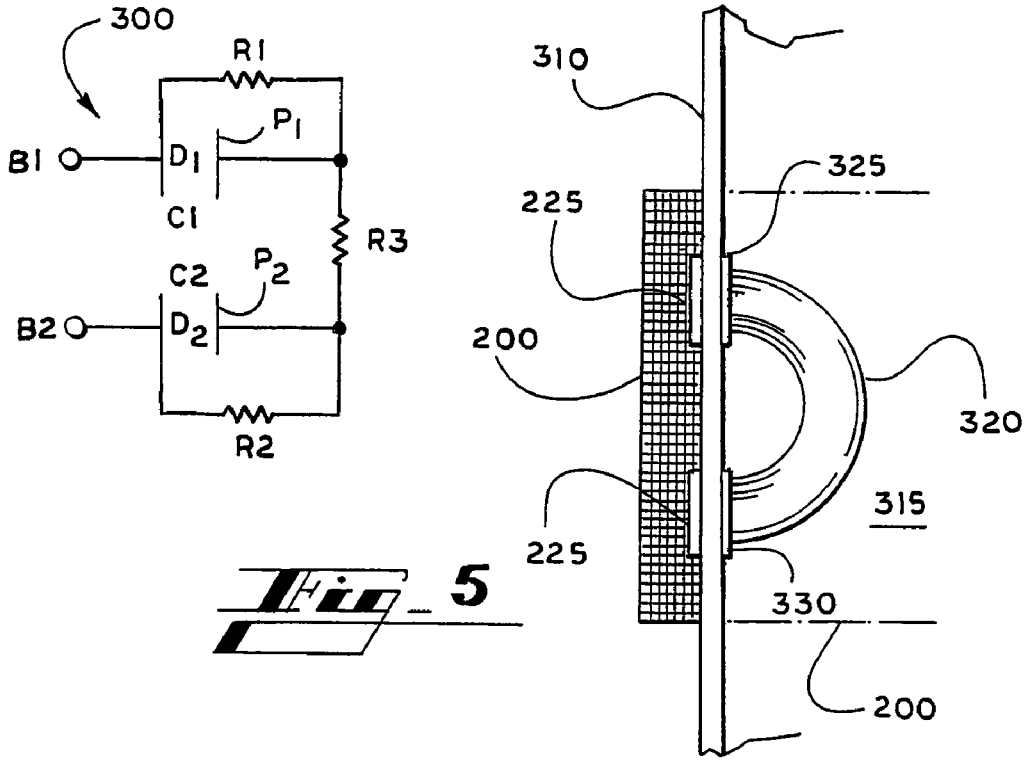
Fig. 5
Fig. 6
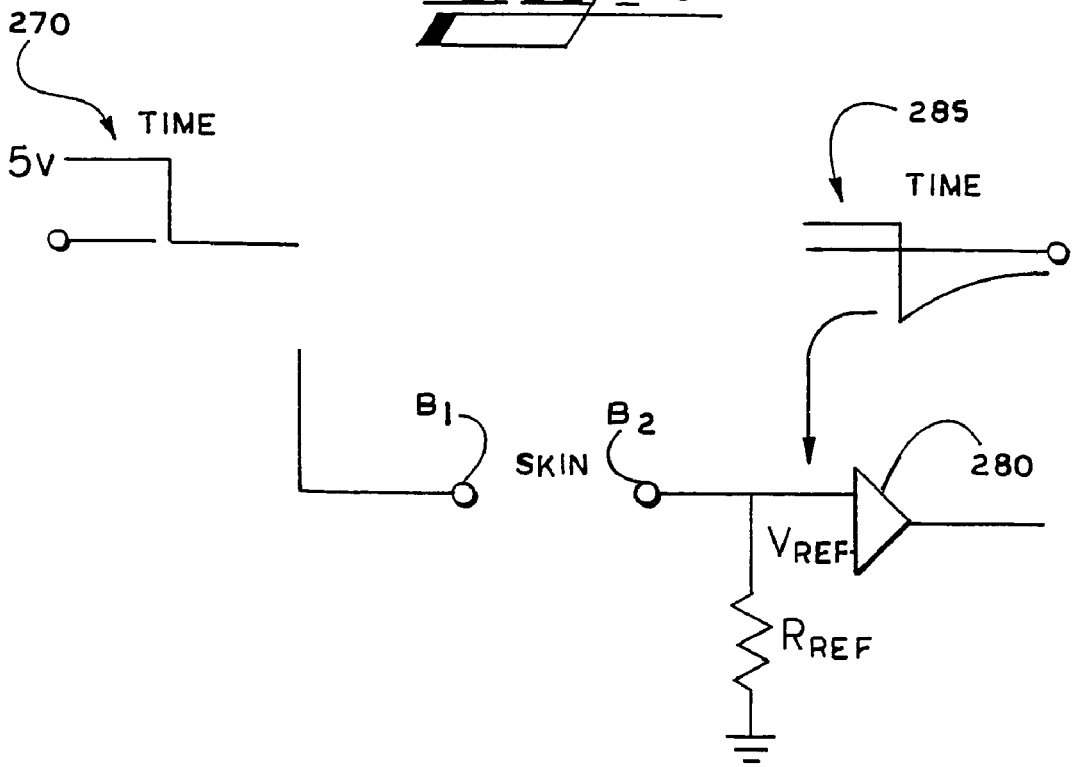

MICROPROCESSOR CONTROLLED SECURITY TAG

CROSS-REFERENCE TO RELATED APPLICATION

This application claims priority to, all benefit of and is a Divisional of U.S. Non-Provisional Utility patent application Ser. No. 10/456,333, filed Jun. 6, 2003, now U.S. Pat. No. 7,132,944, entitled "Microprocessor Controlled Security Tag."

BACKGROUND

I. Field of the Invention

The present invention relates generally to the field of security systems and, more particularly, to a microprocessor controlled security tag apparatus, system and method.

II. Description of the Related Art

Prior security systems where patients need to be monitored typically include a patient tag that sounds an alarm if the tag approaches a prohibited zone or is otherwise damaged or compromised. Prior security systems using tags are limited because often times there are dead zones in the antenna fields used to monitor the tags in prohibited zones. These prior antennas are limited due to the fact that they create fields in which certain orientations of the tag may create null points in which it is possible for a tag to escape detection in the prohibited zone. Other limitations in prior systems are due to the fact that the tags sense the skin direct current (DC) resistivity of the patient which can create detection limitations. For example, in an infant application, an infant's skin tends to be an effective insulator thereby potentially approaching infinite resistance. Furthermore, many prior tags utilize discrete circuitry in processing detection information and can therefore lack processing power to determine certain specific conditions. In addition, the lack of processing power makes it difficult to update features and parameters of the tag.

SUMMARY

In general, the invention features a microprocessor controlled security tag and accompanying security system. The tag generally includes a housing having external contacts to interface with elongated contacts on a connecting band. The band forms an impedance capacitive circuit with a patient's limb that allows detection features such as removal and band compromised. A microprocessor and related circuitry as well as transmitter and receivers are enclosed in the housing. The tag is adapted to communicate inductively with an activator/deactivator unit as well as a tag programmer that updates and changes tag features in the tag firmware. The overall system further includes a hub to receive the data from a plurality of tags in the system. The tag can also communicate with a phased multiple element antenna that sends signals to the tag.

In general, in one aspect, the invention features a security tag apparatus, including a housing having conductive contacts, a band in an interleaved engagement with the housing, the band being coupled to the external leads and a circuit located within the housing;

In one implementation, the band further comprises elongated band conductors in a generally parallel orientation and positioned along the length of the band, the band conductors being electrically coupled to the conductive contacts on the housing.

In another implementation, the band is elastic.

In another implementation, the band conductors are adapted to surround a patient's limb.

In another implementation, the conductive contacts on the housing are coupled to the circuit within the housing.

In another implementation, the band conductors are each a first plate in an impedance circuit.

In another implementation, the apparatus further includes a pseudo plate corresponding to each of the first plates having a dielectric material formed by the epidermal layer of a limb, the dielectric material being located between the first plates and the pseudo plates.

In another implementation, the apparatus further includes a conductive path located between one of the band conductors and pseudo plates and the other of the band conductors and pseudo plates.

In still another implementation, the apparatus further includes a microprocessor coupled to the circuit within the housing.

In another implementation, the microprocessor can receive instructions from an external tag programmer through pulse programming.

In another implementation, the instructions can adjust tag features and parameters.

In another implementation, the instructions are chosen from the group comprising: modifying a band removal skin sense parameter, modifying a band compromise sense parameter, modifying filter parameters, modifying a low battery indication calibration parameter, modifying number of transmissions indicating the end of a battery life, retrieving transmission count, modifying tag loiter transmission management feature parameters, modifying microcontroller internal oscillator calibration parameter, modifying transmission counts before sleep and zone field qualification, selection of band removal-band compromise code reporting method, modifying tag type operation and modifying and retrieving features, parameters, options and data including QC information, calibration information, warranty information and descriptive comment space.

In still another implementation, the circuit is adapted to receive a first signal and retransmit a second signal based on a qualification of the first signal.

In another implementation, the apparatus further includes a low current wake-up circuit portion.

In another implementation, the apparatus further includes a band sense circuit portion.

In another implementation, the apparatus further includes a programming pulse circuit portion adapted to process instructions received from the microprocessor.

In still another implementation, the housing further includes a front end and a rear end, a lower surface and an upper surface, a slot that attached along the length of the rear end, parallel raised walls located toward the rear end, adjacent and generally perpendicular to the slot and a cam lock 145 is pivotally connected to and between the walls.

In another implementation, the apparatus further includes parallel ridged surfaces located on the cam lock and an additional ridged surface located between the conductive contacts, wherein the band is threaded through the slot and formed into a loop and threaded adjacent the cam lock and the ridged surfaces.

In another implementation, the band is woven and the band conductors are integral woven fibers.

In another implementation, the band is woven and the band conductors are integral woven fibers where the band conductors are insulated where contacting skin removing the DC resistance circuit path.

In another implementation, the band is a non-porous elastomer and the band conductors are integral elastomeric conductors.

In another implementation, the band is a non-porous elastomer and the band conductors are integral elastomeric conductors that are insulated where contacting skin removing the DC resistance circuit path.

In another aspect, the invention features a security system, including a security tag having a microprocessor, a transmitter and a receiver, a phased multiple quadrature antenna in communication with the receiver on the tag, a tag receiver in communication with the transmitter on the security tag, a hub in communication with the tag receiver, a tag activation and deactivation device in inductive communication with the tag, a tag programmer in inductive communication with the tag and one or more computers in communication with the tag receiver, the hub, the tag activation and deactivation device and the tag programmer.

In another aspect, the invention features an antenna, including at least two phased antenna elements in a spatially oriented configuration in an antenna plane and at least two independently phased continually excitation sources coupled to each of the phased antenna elements, wherein the phased antenna elements are arranged orthogonally.

In one implementation, the spatial orientation includes a resultant magnetic vector within a defined tag activation zone.

In another implementation, a resultant optimum activation field is a uniform strength received signal at the tag throughout a full 360-degree rotation within a single tag plane defined generally parallel to the antenna plane.

In another implementation, the tag includes a receiver adapted to receive signals from the antenna.

In still another aspect, the invention features a hub apparatus, including a microcontroller that processes information related to a security tag, the information having instructions to qualify band alarms for tag identification data by a request for an alarm code sent from the hub to a computer and a response sent from the computer to the hub.

In another aspect, the invention features a hub apparatus, including a microcontroller that processes information related to autonomously supervising a computer, the information having instructions to alarm or annunciate if a supervise code sent from the hub to the computer and a response sent from the computer to the hub is not received after a timeout.

In yet another aspect, the invention features a security tag programmer apparatus, including a receiver adapted to receive transmissions from a tag having a microprocessor, a transmitter and a receiver, a program pulse coupling forming a part of a mutually coupled inductive circuit, the other part of the inductive circuit being located on the tag and a microcontroller coupled to the receiver and the program pulse coupling, the microcontroller being adapted to process instructions received by the microcontroller and adapted to set features and parameters in the tag.

In another aspect, the invention features a security tag activator and deactivator apparatus, including a tag inductive interface forming a part of a mutually coupled inductive circuit, the other part being located within a tag, a receiver adapted to receive signals from a transmitter located within the tag, circuitry to detect the proximity of the tag to the apparatus, the circuitry being connected to the receiver and circuitry for detecting band removal or a low battery condition, the circuitry being connected to the receiver.

In one implementation, the apparatus further includes an oscillator connected to the tag inductive interface coil used as an antenna for creating a tag activation field.

In another aspect, the invention features a method, including providing a security tag having a band electrically coupled to the tag and internal circuitry including instructions to sense when the band has been removed from a skin surface by detecting impedance changes in a circuit formed between the band, the skin surface, and patient's body and determine if the band has a low impedance condition by detecting impedance changed in the circuit formed between the band, the skin surface, and patient's body.

In one implementation, the method further includes instructions to receive a first signal from a quadrature antenna, when the tag is in a range of the antenna and to return a second signal based on a qualification of the first signal to a tag receiver.

In another implementation, the method further includes instructions to optionally inductively interface with a tag activator and deactivator in order to activate or deactivate the tag and to check power in the tag.

In another implementation, the method further includes instructions to optionally inductively interface with a tag programmer that provides pulse programming to the tag in order to program features and parameters related to the instructions in the tag.

In another aspect, the invention features a security system kit, including a security tag having a conductive band, a microprocessor, a transmitter and a receiver, the band being adapted to form an impedence circuit with a patient, a phased multiple quadrature antenna in communication with the receiver on the tag, the antenna being adapted to generate a signal detectable by the tag, wherein the tag is further adapted to transmit a qualified signal, a tag receiver in communication with the transmitter on the security tag, a hub in communication with the tag receiver, a tag activation and deactivation device adapted to be in inductive communication with the tag and further adapted to check a status of the tag and to activate and deactivate the tag and a tag programmer adapted to be in inductive communication with the tag and further adapted to provide pulse programming through the inductive communication to program features and parameters in the tag.

In another aspect, the invention features a security tag, including a tag circuit enclosed within a housing, the circuit being coupled to conductive contacts on the housing, a band having parallel band conductors electrically coupled to the conductive contacts, means for sensing band removal by detecting an impedance change in an impedance circuit formed in part by the band, the means for sensing band removal being part of the tag circuit, and means for sensing a band low impedance circuit by detecting an impedance change in the capacitive circuit formed in part by the band, the means for sensing the band short circuit being part of the tag circuit.

One advantage of the invention is that the tag can be used as an infant security device.

Another advantage of the invention is that it can detect when it is not in contact with human skin due to impedance detection in the tag circuitry.

Another advantage is that the tag can detect a low impedance condition due to impedance detection in the tag circuitry.

Another advantage is that the tag can be programmed by a pulse programming method that allows parameters and features to be changed after the housing is sealed.

Another advantage is that the tag can receive a signal and transmit a signal that is a qualification of the received signal.

Another advantage is that the presence of a microprocessor on the tag allows for efficient battery management.

Another advantage of the invention is that the quadrature antenna provides a full 360-degree rotation tag detection field.

Other objects, advantages and capabilities of the invention will become apparent from the following description taken in conjunction with the accompanying drawings showing the preferred embodiment of the invention.

BRIEF DESCRIPTION OF THE DRAWINGS

FIG. 5 illustrates a cross sectional view of an embodiment of a tag band in contact with a patient's limb, as well as a schematic representation of the resulting circuit;

FIG. 6 illustrates a block diagram showing a portion of a comparator circuit used for complex impedance sensing;

DETAILED DESCRIPTION

Microprocessor Controlled Security Tag System

Figure 1:
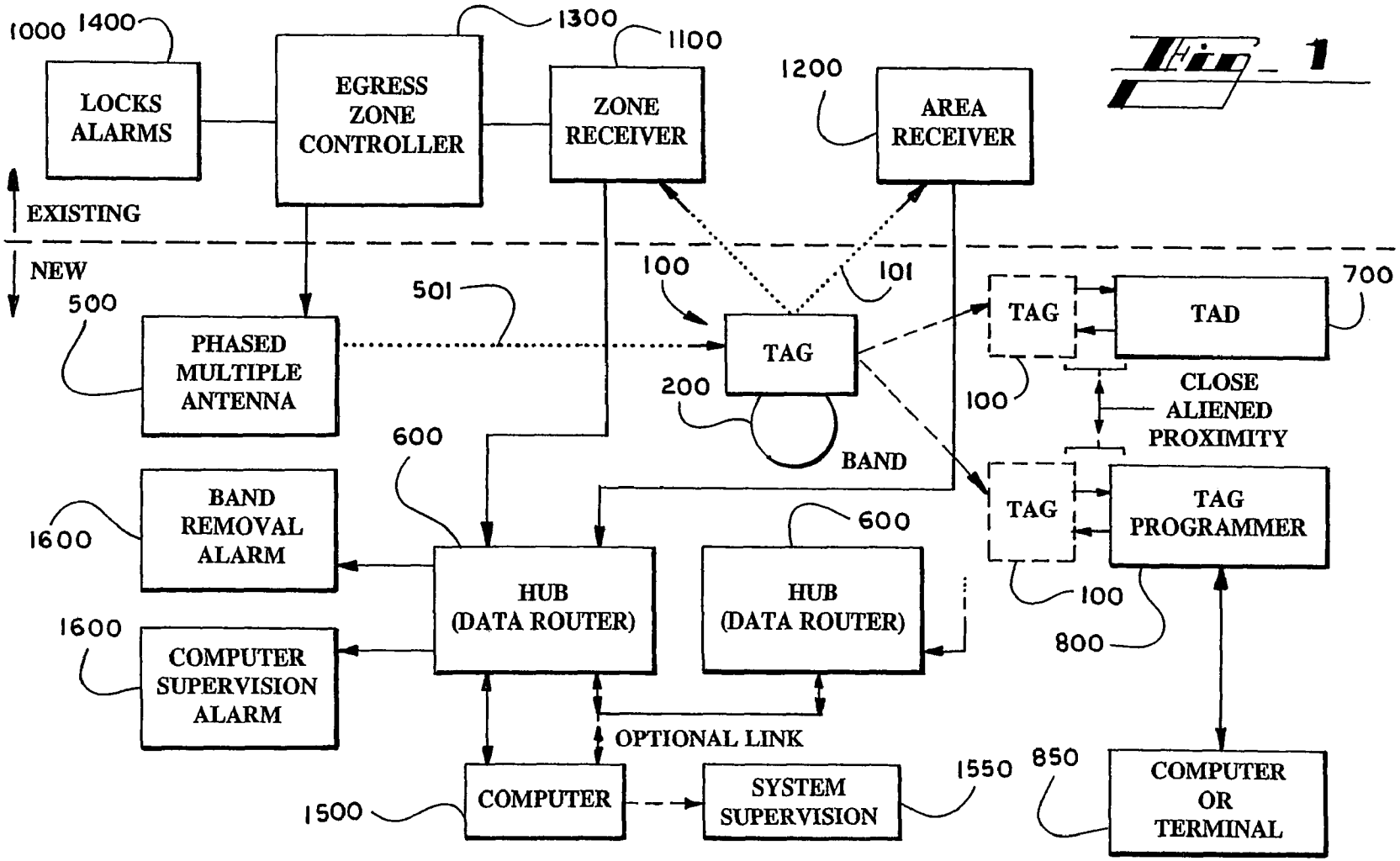
FIG. 1 illustrates a block diagram of an embodiment of a microprocessor-based tag security system.

Referring to the drawings wherein like reference numerals designate corresponding parts throughout the several figures, reference is made first to FIG. 1 that illustrates a block diagram of an embodiment of a microprocessor-based tag security system 1000. The system 1000 is typically centered around a tag 100 that is connected to a patient by a band 200. The tag 100 is used to receive and transmit signals in order to determine if the tag 100 has been removed from the patient or has entered the proximity of a prohibited egress zone. Typically the system 1000 includes many such tags as tag 100 because the system 1000 is typically used in an area having several patients that have to be constantly monitored such as a baby ward.

The system 1000 includes a phased multiple antenna 500 that is adapted to transmit signals 501 that are received by the tag 100 when the tag is in proximity of the antenna 500. The tag 100 in turn appropriately re-transmits a qualified signal 101, the bit rate of the re-transmitted signal being related to the signal 501 transmitted by the antenna 500. This re-transmitted signal 101 aids in the determination of the location in which the tag has entered a prohibited egress point. As such, the system 1000 further includes zone receivers 1100 and area receivers 120 that are used to help determine at which point a prohibited egress point entrance has been made. An egress zone controller 1300 is connected to zone receivers 1100 to receive data from the zone receivers 1100 to make such determinations. The egress zone controller 1300 is connected to locks and alarms 1400 that are used to generate alarms and lock doors, elevators and the like to prevent a prohibited egress while personnel determine which egress point has been potentially compromised. Area receivers 1200 provide additional receive area coverage to receive transmitted signal 101 when the tag 100 is in an alarm status condition.

In one embodiment, the tag receivers are used as a part of the patient abduction-egress prevention system 1000. Receivers convert and recover transmitted alarm data packets from patient attached tags 100 during alarm conditions. These alarm data packets contain the tag ID number of the tag 100 that generated the alarm. The receivers also have an ancillary function of monitoring external controller status, combining additional status generated by the receiver circuit, and converting it to a serial packet form. Since the receivers are an integral portion of a patient security system 1000, supervising the proper function of the receivers is a useful requirement. Typically, receivers are checked by an on board transmitter to determine if the receiver can detect this signal. The supervision transmitter is a CW 418 MHz SAW resonator based transmitter with fixed PCB trace antenna.

A further detailed description of components of this system can be found in U.S. Pat. No. 6,084,513 to Stoffer, which has been incorporated herein by reference.

In one embodiment, proximity of the tag 100 to a 131 kHz antenna 500 is detected by a low level receiver in the tag 100. Reception of a low level signal that is within the specified frequency range results in the transmission of a unique code by the RF transmitter (Typically 418 MHz) within the tag 100. When in a zone, the option exists to transmit the digital code in a synchronous manner in which bits are spaced at a submultiple of the incoming 131 kHz zone signal available at the output of the receiver.

The system 1000 further includes one or more data routers or hubs 600 connected to the area and zone receivers 1100, 1200. The hubs 600 are used to collect all tag data not previously used or validated and concentrates the data received by the egress zones and distributed area receivers. The hubs 600 are connected to one or more computers 1500 under system supervision 1550, to ultimately process all received data. The hubs 600 are further connected to one or more types of alarms 1600 that are used to trigger alarms if the appropriate alarm data has been processed from the tags 100. It is understood that a plurality of hubs 600 can be connected to a plurality of zone and area receivers 1100, 1200 in various configurations.

The system 1000 can include one or more tag activator/deactivators ("TADs") 700. The TADs 700 are generally used to activate and deactivate the various tags in the system. By activating a tag, the system 1000 is aware that the tag is now a tag that can receive and transmit data regarding band removal, band compromised, egress proximity and the like. By being deactivated, a particular tag is not under monitor as an activated tag. The TADs 700 are also used to check the battery power of a given tag and to anticipate tag communication allowing access of tag features and parameters.

The system 1000 can also include one or more tag programmers 800. The tag programmers 800 are used primarily to activate and deactivate tag features as described in further detail below with respect to FIG. 2. In one embodiment, in general, programming of the tag 100, for the purpose of enabling or disabling of tag features, including tag ID number, power on/off and function selection is accomplished by the application of a high level programming pulses modulated by rate. This modulation is interpreted by the microprocessor within the tag for control of these features. The TADs 700 and the tag programmers 800 are typically are typically connected and interfaced to a computer 850.

Further features of the tag 100, antenna 500, hub 600, TAD 700 and tag programmer 800 are discussed individually in further detail with respect to the following figures.

Microprocessor Controlled Security Tag

Figure 2:
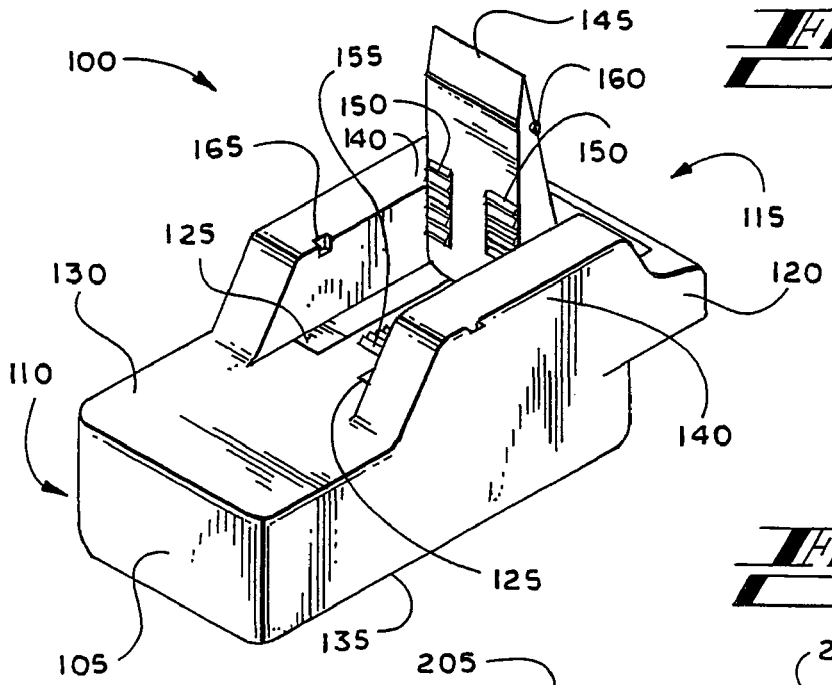
FIG. 2 illustrates a perspective view of an embodiment of a security tag.

FIG. 2 that illustrates a perspective view of an embodiment of a micro-controller-based security tag ("tag") 100.

The tag 100 generally includes an outer housing 105 having a front end 110 and a rear end 115, a lower surface 130 and an upper surface 135. The rear end 115 includes a slot 120 that generally is attached along the length of the rear end 115 of the housing 105. The slot 120 is adapted to receive a band as described further below. The tag 100 further includes conductive contacts 125 located on the lower surface 130. The contacts 125 are generally in a parallel orientation and are electrically coupled to circuitry inside the housing 105. The circuitry inside the housing 105 is discussed in further detail in the description below. The housing 105 further includes parallel raised walls 140 located toward the rear end 115, adjacent and generally perpendicular to the slot 120. A cam lock 145 is pivotally connected to and between the walls 140. The cam lock 145 is shown in an open position. The cam lock includes parallel ridged surfaces 150. An additional ridged surface 155 is located between conductive contacts 125. When the cam lock 145 is in a closed position the ridged surfaces 150 are positioned adjacent ridged surface 155. The cam lock 145 further includes male tabs 160 that are adapted to mate and snap into female recesses 165 when the cam lock 145 is in the closed position. The cam lock 145 is adapted to secure a band against the housing as described further below.

Figure 3:
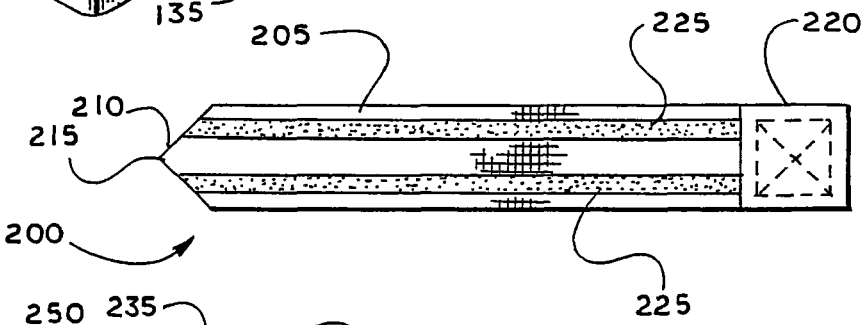
FIG. 3 illustrates a top view of an embodiment of a tag band.

FIG. 3 illustrates a top view of an embodiment of a tag band 200. The band 200 is generally made of a elastic, stretchable material. The band can generally be elastic but can also be inelastic for other uses. For example, non-stretch bands 100 with integral conductor paths can be implemented in both pediatric and adult use where intentional removal is discouraged but can still be monitored by band removal methods. The band 200 can be for single patient use or can be reusable by washing and disinfecting. The band 200 can also be moisture resistant by being non-porous. In general, the band 200 can be soft particularly for infant patient use.

The band 200 includes an elongated body 205 having a leading end 210 and a rear end 220. The leading end 205 can include a tipped edge 215 in order to aid a user in guiding the band 200 through the slot 120 of the tag 100. The rear end 220 is typically a portion of the body 205 that has been folded onto itself and glued into place. The band 200 further includes band conductors 225 that are woven into the elongated body 205. The band conductors 225 are generally parallel to one another and run the entire length of the elongated body 205. The band conductors 225 are adapted to stretch along with the body 105 as the band 200 is stretched and restored. In a typical embodiment, the band 200 is woven with integral woven conductive fibers that make up the band conductors 225. In another embodiment, the band 200 can be inelastic made from a non-porous elastomer with integral elastomeric conductors. This embodiment provides increased immunity to moisture absorption and can be more easily disinfected and reused.

Figure 4:
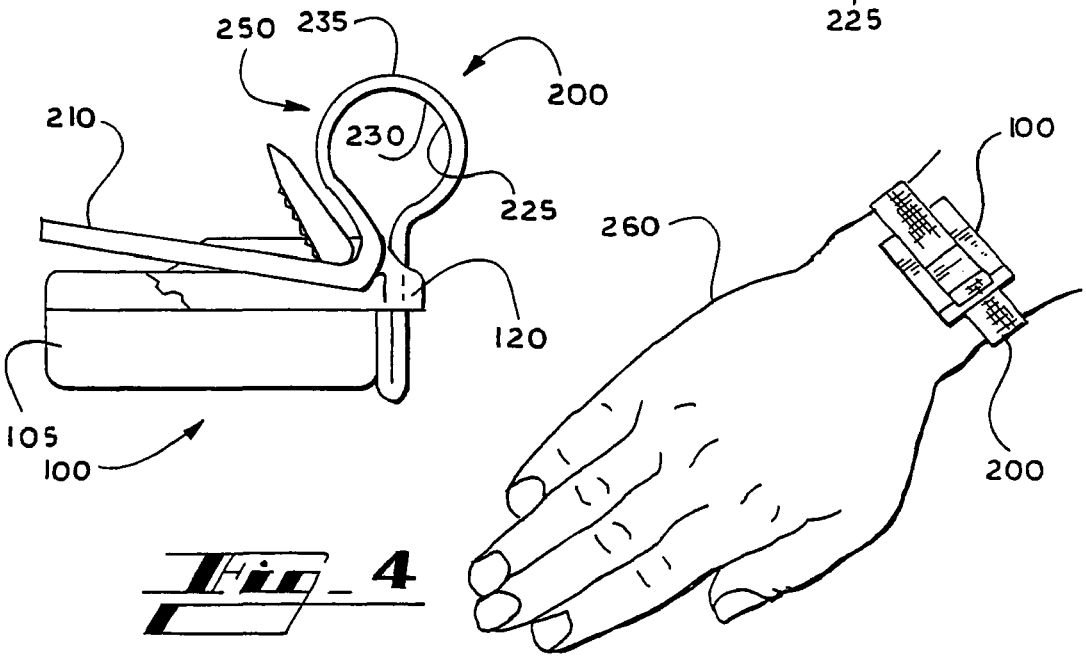
FIG. 4 illustrates the embodiment of the security tag of FIG. 2 connected and coupled to the embodiment of the tag band of FIG. 3.

The tag 100 and the band 200 are used in conjunction as a patient security device. FIG. 4 illustrates the embodiment of the security tag 100 of FIG. 2 connected and coupled to the embodiment of the tag band 200 of FIG. 3. A suitable band path is defined when the band 200 is affixed to the tag 100. The band path is important so that the band conductors 225 are properly positioned against a patient as well as against the conductive contacts 125 on the tag 100. In general, the user threads the band 200 through the slot 120 on the tag housing 105 and then continues to thread the band 200 underneath the cam lock 145 through a space between the cam lock 145 and the lower surface 130 of the housing 105. The user typically retains a loop 250 retained in the band 200. This loop 250 allows a patient's limb to be inserted through the loop 250 for securement to the patient. In this orientation, the band conductors 225 are oriented inwards of the loop 250. With the band conductors 225 positioned inward of the loop 250, when the band 200 is placed onto a patient, the band conductors 225 are positioned against the patient's skin. As more clearly illustrated in FIG. 3 the band conductors 225 are positioned on an inner surface 230 of the body 205. The body 205 further includes an outer surface 235. Furthermore, by positioning the conductive strips 225 in this manner, the conductive contacts 125 are in contact, and therefore electrically coupled and interface with the conductive strips 225.

The user pulls the band 200 so that the folded rear end 220 of the body 205 is positioned adjacent the slot 120. The folded rear end 220 is typically larger than the opening of the slot 120. Therefore, the rear end 220 cannot be pulled through the slot 120 and the rear end 120 is secured against the slot 120. Once a patient's limb is secured through the loop 250, any slack in the band 200 can be pulled by continuing to pull the leading edge 210 of the band 200. Once a desired placement is achieved. The cam lock 145 is then closed, wherein the male tabs 160 are snapped to the female recesses 165, thereby locking the cam lock 145. The ridged surfaces 150, 155 press into the band 200, thereby locking the band 200 into place so that it becomes difficult or impossible to move the band 200 with respect to the tag 100. When the cam lock 145 is locked into place, the band conductors 225 are also pressed firmly against the conductive contacts 125. In a typical implementation, the ridged surfaces 150, 155 are oriented such that the band can be pulled in one direction to tighten the band 200, but not in the opposite direction to loosen the band 200. In this implementation, the cam lock 145 must be opened in order to loosen the band 200. Excess band 200 on the leading edge 210 can be cut away by scissors or any suitable cutting device. In general, the band path aids to keep the tag 100 away from the patient. Furthermore, the band path allows the band 200 to fully contact the circumference of the patient's limb. In general, the band 200 holds the band conductors 225 next to full circumference of the patient's limb for maximum results. When implementing an elastic material, the band 200 can be held close to the full circumference of the patient's limb thereby holding the band conductors 225 close to the skin.

FIG. 4 further illustrates a patient's limb 260 with an affixed tag 100 and band 200.

As mentioned above, the band conductors 225 are positioned against a patient's skin. By positioning the band conductors 225 in such a manner, the band conductors 225 along with the patient's skin form a unique circuit that allows for unique detection of various conditions including, but not limited to band removal, low impedance and general impedance sensing. The unique detection can be accomplished by the formation of a capacitive circuit, the band conductors 225 being a plate of a capacitor and the patient's skin being another plate of a capacitor. The different layers of the patient's skin act as both a dielectric material as well as a resistive path. Therefore, different detections can be achieved by testing the overall complex impedance of the circuit, which includes both resistivity and capacitive impedance of the patient's skin. A complex impedance (capacitive and resistance) timing method can be implemented. Typically, the time constant RC can be determined for a typical system. If RC varies according to certain predetermined conditions, certain alarms can be triggered.

FIG. 5 illustrates a cross sectional view of an embodiment of a tag band 200 in contact with a patient's limb, as well as a schematic representation of the resulting circuit 300. Each conductive band 225 is in opposition to a portion of the patient's skin, generally the interface between the epidermal layer 310 and subcutaneous layer 315. This portion is designated as a pseudo-plate 325, 330. The epidermal layer 310 effectively acts as a dielectric material between the respective capacitive plates 225, 325 and 225, 330. In another embodiment, an additional dielectric layer can be provided on the band 200 itself between the band conductors 225 and the patient's skin. The subcutaneous layer 315 acts as resistance to a resultant conductive path 320. The schematic representation 300 illustrates two capacitors C1, C2 formed by band conductor plates B1, B2 and respective opposite pseudo-plates P1, P2, having dielectric material (from epidermal layer 310) D1, D2 and leakage resistance of dielectric D1, D2 is illustrated as parallel resistors R1, R2. General resistance (of the subcutaneous layer 315) is illustrates as parallel resistor R3.

FIG. 6 illustrates a schematic diagram showing a portion of a comparator circuit 265 used for complex impedance sensing. In general, sensing of the impedance between the two band conductors 225 is implemented by an application of a voltage step function to one of the band conductors 225 and then monitoring the current flowing through the other band conductor 225. This band current flows through the reference resistor to produce a voltage. This voltage has temporal characteristics primarily determined by the complex impedance as described above. In general, in the absence of skin contact, this impedance is mostly capacitive and quite large (on the order of picofarads in parallel with a resistance typically larger than 2×10E9 ohms.) When the band is in contact with skin, the inter-band conductor 225 complex impedance is lowered (increased capacitance and/or lowered resistance.) Typically, two impedance limits are sensed to determine two alarm states, band removal from contact with the skin or low impedance test indicating either band tampering or a wet band. The first band conductor 225, B1 is connected to voltage step function 270. In one implementation, the circuit 265 uses two sequential time intervals, the first, in which the second band conductor 225, B2 is connected to a high impedance load senses band removal, and the second, in which the second band conductor 225, B2 is connected to a low impedance load. Transition beyond a predetermined voltage threshold level Vref, as compared using comparator 280 during either interval triggered the appropriate alarm state. Typically, the resulting voltage waveform 285 is analyzed to determine whether the condition has been met.

With such a capacitive and impedance-based system in place between a patient's limb and the tag 100 and band 200, several features result. As mentioned above, band removal can be sensed, typically resulting in lowered complex impedance. When the complex impedance is low enough to prevent a comparator circuit from reaching a threshold within a certain specified time, an alarm can be triggered. As described further below, a band status can be transmitted as a unique digital alarm code by a RF transmission (typically 418 MHz) from the tag, or can be combined into a common code with a band-compromised function.

Low impedance can also be sensed with the circuit. When the overall impedance falls below a predetermined threshold value, an alarm can be triggered. The alarm can be transmitted as a unique digital alarm code by an RF transmission, or can be combined into a common code with the band removal alarm. This features is typically used to sense when a band impedance sensing function has been compromised by a low impedance shunt path, as typically happens if the band is dampened, by urine for example.

Figure 7:
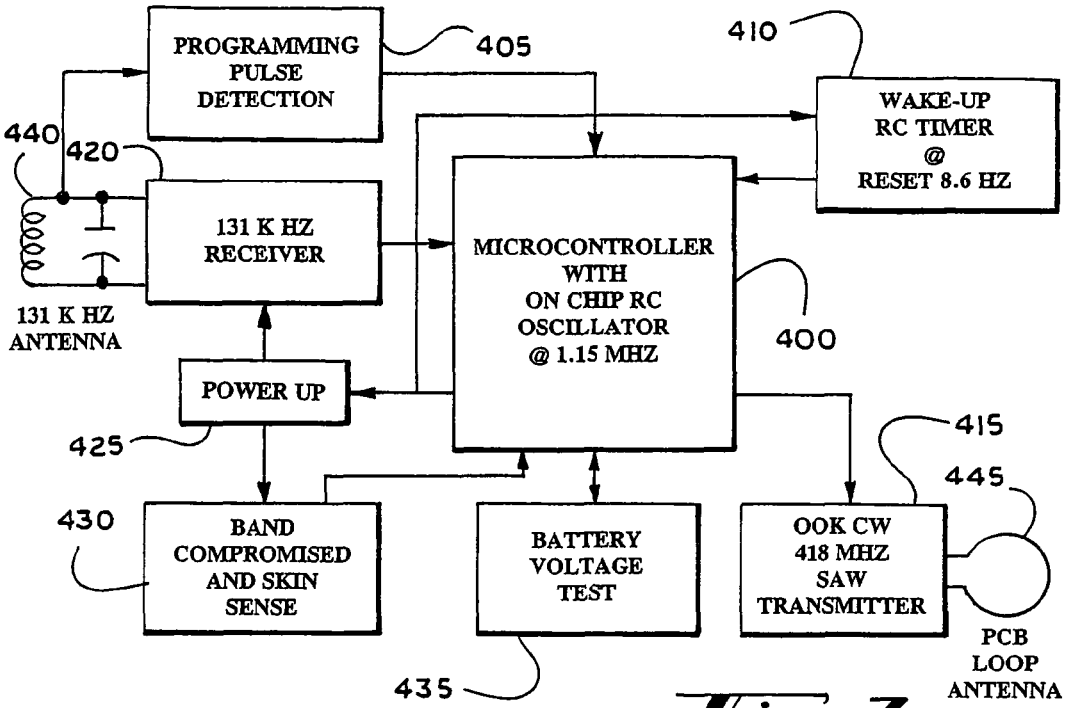
FIG. 7 illustrates a block diagram of an embodiment of a microprocessor based security tag.

FIG. 7 illustrates a block diagram of an embodiment of a microprocessor based security tag 100. The tag 100 includes a microcontroller 400 that, in one embodiment, can include an on-chip RC oscillator at 1.15 MHz. The microcontroller 400 is connected to a wake-up timer 410 that, in one embodiment, can be an RC timer at 8.6 Hz. The microcontroller is further connected to a battery voltage test module 435, a band compromised and skin sense module 430 and a power up module. The microcontroller 400 is typically also connected to a 131 kHz receiver 420 and a programming pulse detection module 405. The 131 kHz receiver is connected to a 131 kHz antenna that is used to receive signals from the phased multiple antenna 500 as described above with respect to FIG. 1. The programming pulse detection module 405 is used to aid in programming the tag 100 as described further below. The microcontroller is also connected to a transmitter module 415 that, in one embodiment, can be an On-Off Keyed (OOK) continuous wave (CW) 418 MHz SAW transmitter. The transmitter module is connected to a PCB loop antenna 445 that is used to retransmit received antenna signals.

In general, the tag 100 is used as a part of a patient abduction-egress prevention security system that is discussed in further detail in the description below, the tag being a patient-attached portion of the system. In one embodiment, the tag 100 has two basic modes of operation. In one mode of operation, an alarm transmission is activated when an attempt is made to remove the tag 100 from the skin of a patient, which would compromise the patient's security. In the other mode of operation, a transmission occurs when the tag 100 enters a 131 KHz field in a zone near a door or other egress point. In one implementation, the tag 100 uses an On-Off Keyed (OOK) CW 418 MHz SAW resonator based transmitter with fixed PCB loop antenna.

During normal use, the microcontroller 400 within the tag 100 spends most of its life in a sleep mode waking up for very short periods of time to check the status of skin sense circuitry and the 131 KHz receiver. If no activity is detected the microcontroller 400 places the tag 100 back into the sleep mode. However, if the test detects the band portion of the tag 100 has been removed from the skin, the microcontroller 400 continuously transmits tag ID number and BR code data packets as long as the alarm condition lasts. In a typical implementation, a single test pulse on wake-up is implemented to conserve power on the tag 100. If the tag 100 has entered into a protected egress point, defined via a 131 KHz field surrounding the egress point, the 131 KHz is detected by the tests conducted during wake-up and the tag 100 transmits tag ID and zone code data packets as long as the tag remains in the 131 KHz field. The egress zone equipment uses these transmissions to lock a door and/or sound an alarm thus preventing patient egress or abduction.

As mentioned above, the programming pulse detection module 405 is used to aid in programming the tag 100. In one implementation, the tag programmer 800 uses a programming pulse method that, among other things, allows excitation of the tag 100 while the received signal amplifier is powered down (typically, off or standby). Similarly, the TAD 700 can be used to activate and deactivate the tag 100. The software within the tag 100 looks for a signature pattern on the program data line and interprets it as an activate-deactivate command. This allows for ease of attachment of the tag 100 or power-down when the tag 100 is not in use. The software within the tag 100 provides for alarm delay timings to provide for ease of use and attachment to the patient. The tag 100 arms itself within a period of time after the software senses skin contact. In addition, the tag 100 transmits an activate/deactivate code and personal code to supervise which personnel is attaching or removing the tag 100. The TAD 700 is typically used for power or alarms only, however, it is anticipated that it will be able to monitor internal tag parameters.

In general, the programming pulse method allows for ease of attachment or power-down because the system 1000 anticipates use and attachment timings. For example, in one implementation, an active time delay can be used after skin sense is detected. In general, the tag 100 can transmit an activate and deactivate code as well as a personal code when appropriate for programming and activation/deactivation.

The programming pulse method also allows for after manufacture data programming and retrieval for feature and parameter adjustment in internal firmware, since the tag housing 105 is sealed. The tag software interprets programming pulses at two different rates corresponding to ones and zeros allowing for tag data access of the internal EEPROM data memory of the microcontroller 400 through tag programming access codes (commands). The tag 100 replies with data through the normal data packet transmission method used for tag ID and alarm code transmission. The program pulse method allows for parameter access and function control after manufacture once the tag 100 case is sealed closed.

There are several additional features and advantages of the programming pulse method, including but not limited to: modifying band removal sense timing parameter that allows for different band conductor surface areas and band length (e.g, circumference); modifying band compromise sense parameters; modifying filter parameters that allows for different received signal frequency ranges and allows for different and removal alarm timings; modifying low battery indication calibration parameter that allows for calibration of measured analog trip point; modifying number of transmissions indicating end of battery life that allows battery usage to be a factor in calling a low battery condition; retrieving transmission count that is a method to determine actual Tag transmission usage and allows better warranty and tag 100 misuse management; modifying tag 100 loiter transmission management feature parameters that allows for changing the timing parameters; modifying microcontroller internal oscillator calibration parameter that allows adjustment of the internal oscillator calibration (this oscillator is used as a time reference for measurements); modifying transmission counts before sleep and zone field re-qualification that allows for adjustment of the zone re-qualification rate; selection of band removal-band compromise code reporting method, which can be combined or separate code reporting; modifying tag 100 type operation that allows tag 100 after manufacture to be configured for different product applications (i.e. ES, IS, BR); modifying and retrieving features, parameters, options, and data (i.e. QC info, calibration info, warranty info, descriptive comment space, etc.) in general after manufacture as made available by application access software (TAD or Programmer); and data coding and data rate alternatives. It is understood that several additional modifications and programming can be achieved using the programming pulse method.

The tag 100 includes several additional features such as received signal frequency qualification where a received signal is measured digitally and checked to be within frequency limits. The tag software uses a counter within the microcontroller 400 to count the received zone signal transitions for a set period of time that allows for frequency measurement. This allows the received signal to be qualified to be within set frequency limits. These features helps to reject non-system problem interference sources, accommodates a lower Q tuned antenna in a flatter response to stagger tuned multi-zone discrimination yet allows sharp rejection of out of band signals. Available parts can be utilized verses tuning a higher Q circuit.

A battery-low indication voltage testing and transmission usage feature allows Battery voltage testing with timing methods related to battery draw down while transmitting. The tag 100 uses actual transmissions as an indicator to determine remaining battery capacity. The tag 100 further includes a battery management feature. In general, an ultra low current wake-up circuit (current draw below what is available within microcontrollers) is implemented in order to conserve power. Power control of received signal amplifier allowing increased tag 100 range yet low overall current draw. Power control of band sense circuits allows measurement at low current draw. Loiter management is implemented in order to reduce transmission data packet frequency and resulting reduced battery consumption.

The software within the tag 100 performs battery voltage measurements using an RC comparator timing technique. The battery voltage measurement is scheduled by software for a time after the tag 100 has been transmitting and the battery has been loaded. After transmission is done for some period allowing for slight battery recovery and a time not to interfere with normal tag data packet transmissions an actual loaded measurement is made. Since battery voltage is not a totally reliable indicator of remaining capacity, actual bit on-time transmissions are accumulated as an indication of battery capacity remaining. A combination tag use and battery voltage is used to determine a low battery (low remaining capacity). Timing parameters and thresholds are set via the tag programming means. A low battery state is reported by a low battery code.

Using the band 200 with the two band conductors 225 as capacitive plates and also simultaneously as electrodes allows a complex impedance (capacitive and resistance) timing method to be implemented. A band to human interface provides a circuit model as shown above in FIG. 5. Since the presence of the band 200 has to be sensed continuously on the small battery powered tag 100, power consumption is a concern. This concern is addressed by exciting the band 200 with one pulse every time the microcontroller 400 within the tag 100 wakes up to run a band test. In another implementation, this technique can be used for multiple and continuous excitation.

The following figures illustrate certain circuit features of the tag 100 in more schematic detail.

Figure 7A:
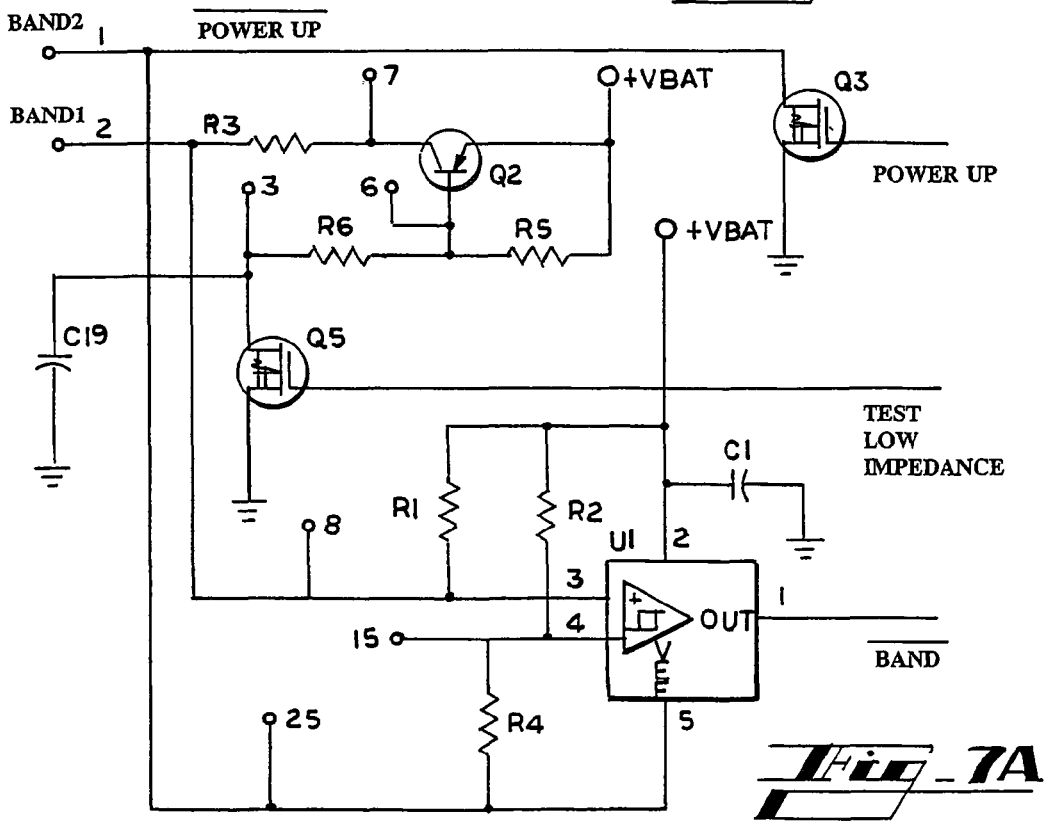
FIG. 7A illustrates a schematic diagram of an embodiment of a band sense circuit portion within the tag.

FIG. 7A illustrates a schematic diagram of an embodiment of a band sense circuit portion within the tag 100. When the microcontroller 400 wakes up, the BAND2 connection is taken from a quiescent state to ground. A resistance-capacitance (RC) circuit is established through R1 and the resistance and capacitance of the band-human interface. As the capacitance charges on the band-human interface or a voltage divider effect produced by resistance on the band-human interface causes voltage on node 8 to eventually cross reference voltage on node 15 at which point a comparator U1 changes state. The time it takes to charge this capacitance and change the comparator state is measured by the microcontroller 400 and is indicative of whether the band is on or off the patient's skin. The timing set point can be modified to accommodate different band lengths, circumference and the like. When a band removal is detected, a band removal code is transmitted from the tag 100.

Referring still to FIG. 7A, to overcome the possibility of an attempt to defeat the band detection mechanism or if the band is compromised inadvertently by moisture, a low impedance test can be implemented. When this test is conducted, Q5 is turned on drawing a current through R5 and R6, thereby turning on Q2 connecting R3 to +VBAT. These changes effectively change R1 to a much lower resistance, thereby allowing the comparator U1 to detect low impedance on the band 200. When a band-compromised condition is detected, a band-compromised code or BR code is configured for transmission from the tag 100.

To keep band movement from causing false alarms, digital signal averaging is implemented by the microcontroller 400 before an error or alarm is determined and codes are transmitted.

Figure 7B:
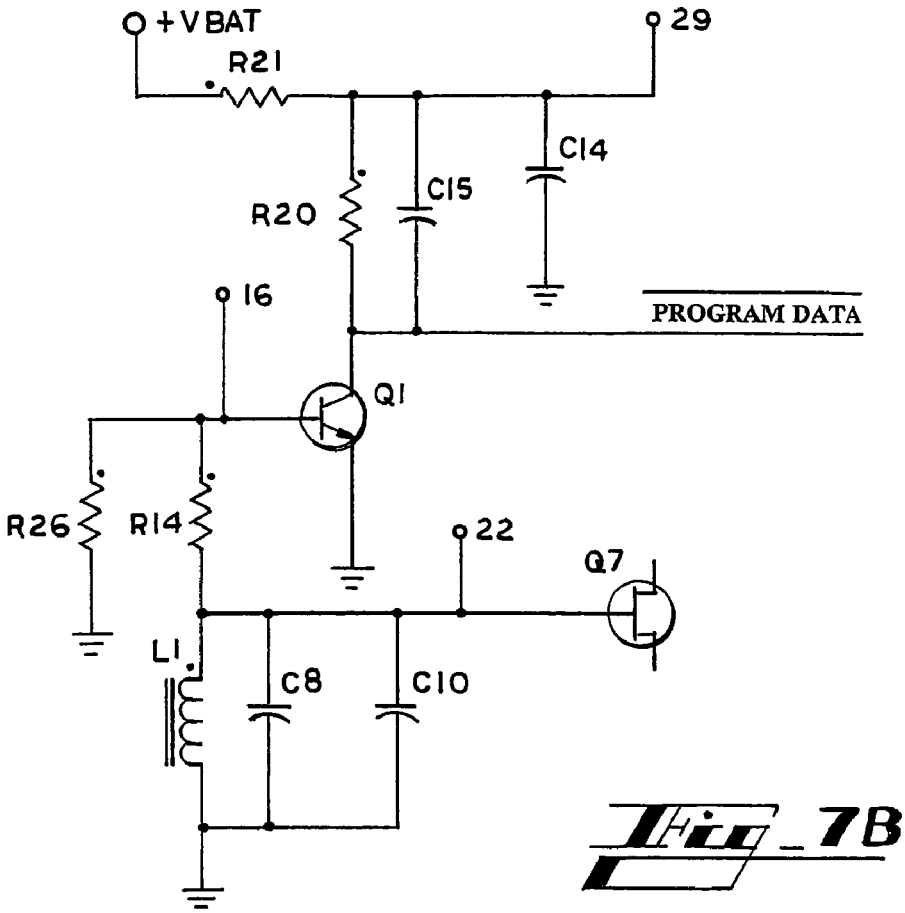
FIG. 7B illustrates a schematic diagram of an embodiment of a pulse programming circuit portion within the tag.

FIG. 7B illustrates a schematic diagram of an embodiment of a pulse programming circuit portion within the tag 100. As mentioned above, the tag 100 is in the sleep state most of the time to conserve battery power during which time the received signal amplifier, band sense, and the transmitter are powered down. By producing a large magnetic pulse in a coil within the TAD 700 or tag programmer 800 and coupling it to the received signal antenna inductor as shown (see FIGS. 11-13 below), a sufficient voltage is developed in an inductor L1. This voltage is relatively larger than any produced by the received zone field activation signal. This signal does not require amplification by the possibly unpowered Q7 FET but still causes a current to flow through R14 and R26 turning on Q1. The transistor Q1 connects resistor R20 to ground producing a program data pulse for the microcontroller 400.

Figure 7C:
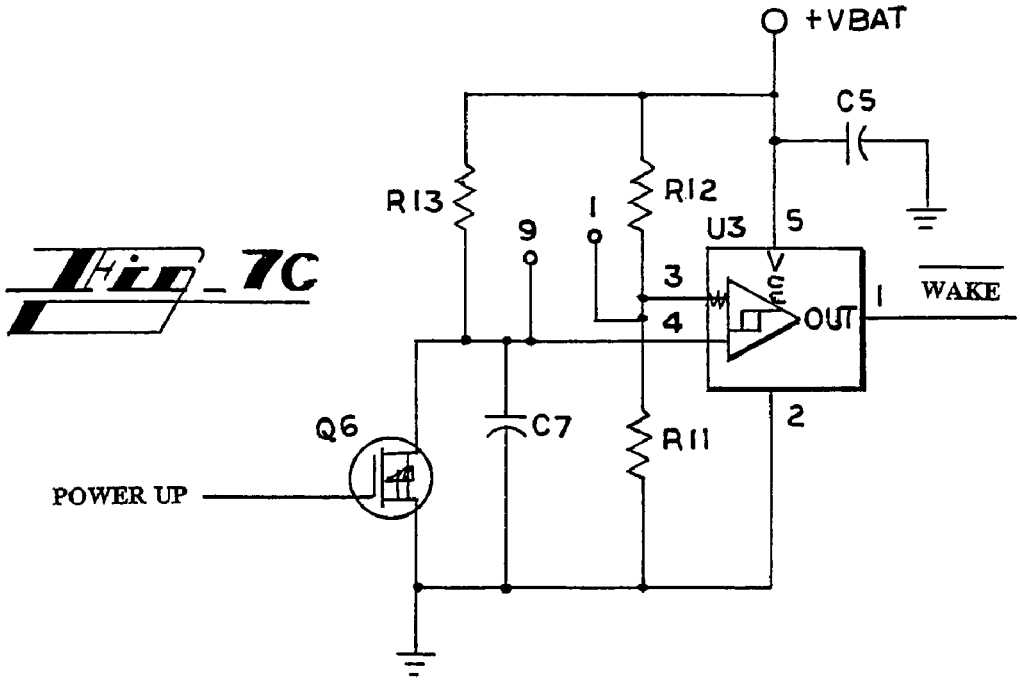
FIG. 7C illustrates a schematic diagram of an embodiment of awake up circuit portion within the tag.

FIG. 7C illustrates a schematic diagram of an embodiment of a wake up circuit portion within the tag 100. The tag 100 typically has a small capacity battery that must function for long periods of time battery capacity use is of tremendous concern. Therefore, steps to conserve capacity must be taken. In the tag 100, the microcontroller 400 is placed in the sleep mode as much as possible to conserve power. However, when the microcontroller 400 is asleep a stimulus of some kind is needed to wake the microcontroller 400 at some standby rate. Even though microcontrollers currently available have wake-up timers internal they still use more current than desirable for long-term shelflife. Therefore, the tag 100 contains a wake-up circuit that has ten times the performance over RC timers internal to microcontrollers. A very high impedance and low leakage circuit with state-of-the-art comparator U3 is employed. Capacitor C7 charges through R13 and when the voltage at node 9 crosses the voltage at node 1 set by reference voltage divider of R12 and R11 the a wake signal is produced. When the microcontroller 400 is running and powers up the circuit low leakage MOSFET Q6 discharges C7 to allow another timing cycle as soon as the rest of the circuit is powered down and the microcontroller re-enters sleep mode.

Other methods of power conservation used are low duty cycle powering of the received signal amplifier and band sense circuits. These methods allow use of an amplifier for the received signal increasing the range of the tag 100 yet maintaining low overall current draw. Likewise, circuitry is employed to do the band sensing that would otherwise draw too much current.

The tag 100 transmits zone and/or alarm codes when in the tag 100 senses it is in a zone. If this happens often or for long periods of time considerable battery capacity can be consumed. These loiter conditions are managed by reducing the transmission data packet frequency after a period of time until the tag leaves the zone.

Quadrature Antenna—Tag Activation Field

As described above, with respect to FIG. 1, a phased multiple antenna 500 that is adapted to transmit signals 501 that are received by the tag 100 when the tag is in proximity of the antenna 500 is included in the system 1000. Magnetic fields generated by a single loop antenna generate linearly polarized fields that are characterized at any point distant to the antenna by a single linear vector component. Consequently, a receiving loop antenna placed at any distant to the source antenna has an induced voltage that is maximized only when the axis of the receiving antenna is aligned with the local magnetic field vector. With this design, the receiving antenna voltage is null whenever its axis lies within a plane perpendicular to the vector. This represents a continuum of null angles. By using continuous excitation, the received signal is more consistent than a system with multiple loop antennas with several orientations and a controller that excites one axis at a time while hunting for the antenna axis that returns the best response form the tag 100.

Figure 8:
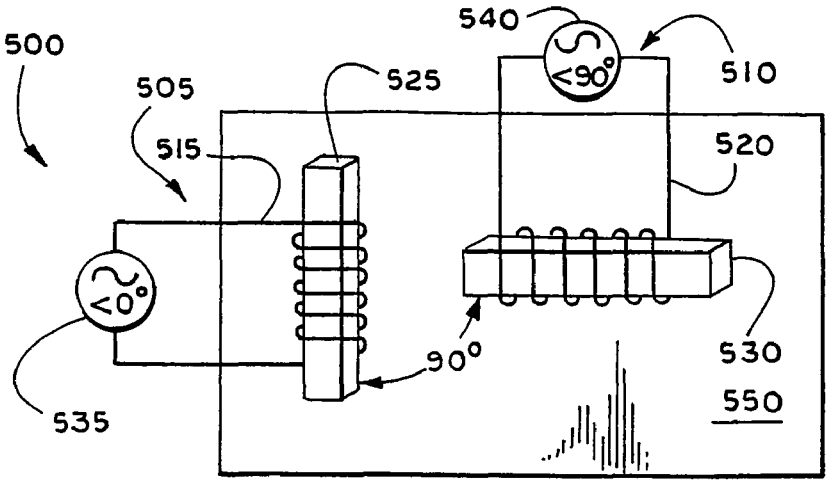
FIG. 8 illustrates an embodiment of a phased multiple quadrature antenna.

FIG. 8 illustrates an embodiment of a phased multiple quadrature antenna 500. In the quadrature antenna 500 design, two antennas 505, 510 are spatially oriented so as to create magnetic components that are essentially orthogonal. The two antennas 505, 510 are typically oriented in a common plane 550. In a typical embodiment, the two antennas 505, 510 are ferrite rod antennas including a coil 515, 520 wrapped around a ferrite core 525, 530. Each of the antennas 505, 510 are connected to phased signal circuitry 535, 540. These antennas are excited by the circuitry 535, 540 that ensures that the first antenna 505 generates an time varying magnetic field with a sinusoidal component at a reference phase angle of 0 degrees and that the second antenna 510 is excited so that it generates a time varying magnetic field at a phase angle of approximately 90 degrees relative to the first.

Typically, in the circuitry 535, 540 two separate transmitter excitation sources at the same frequency are used, one driving the first antenna at a phase of 0 degrees and the second driving the second antenna at a phase essentially 90 degrees leading or lagging relative to the first. The resultant field distant to the antennas contains components that are orthogonal such that a receiving antenna experiences a null only if its axis is perpendicular to the plane defined by these essentially orthogonal components. Therefore, unlike the linear antenna situation defined above, a null is possible with only a single orientation. As a consequence, the quadrature design greatly reduces the likelihood that a tag can enter a transmitting zone field without detection.

The quadrature design can be implemented with several configurations. The antennas 505, 510 can be in close proximity, or distant, as long as they generate fields with vector components that are essentially orthogonal at a point where tag 100 activation is desired. Likewise, multiple antenna arrays can be used in which several antennas are used to provide the 0 degree component and several are used to provide the 90 degree component.

Figure 9:
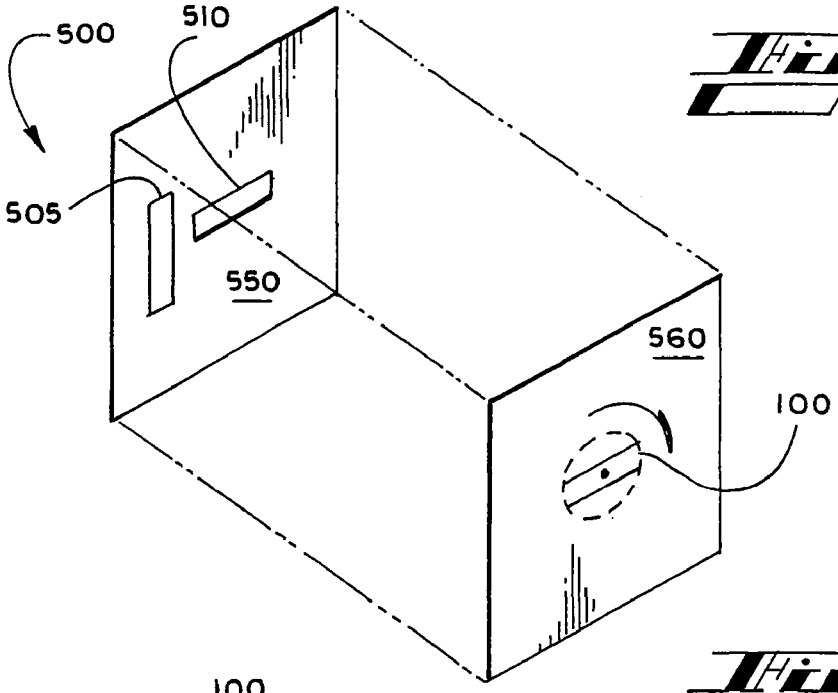
FIG. 9 that illustrates a multiple phased antenna plane relative to a tag orientation plane.

Referring now to FIG. 9 that illustrates a multiple phased antenna plane 550 relative to a tag orientation plane 560, an example of the relationship between the antenna 500 and tag 100 is now discussed. Two or more spatially oriented loop antennas 505, 510 that are continuously excited by at least two or more independently phased sources are oriented in the multiple phased antenna plane 550 that is generally parallel to the tag orientation plane 560. These spatially oriented loop antennas 505, 510 have the capability to give uniform maximum received signal strength at the tag 100 in a two axis space.

As described above, the antenna elements are spatially oriented. Planar antenna elements 505, 510 are also orthogonally oriented between the elements 505, 510 within the plane 550. Two or more independently phased excitation sources are used to drive the antennas 505, 510. Two sinusoidal excitation sources of the same frequency 90 degrees different in phase are applied to two orthogonal related antennas 505, 510. Antenna elements 505, 510 are spaced in close proximity or distant as long as the resultant additive magnetic vector is of sufficient strength throughout the defined tag 100 activation zone. The resultant tag 100 activation field for an embodiment is a uniform strength received signal that the tag 100 throughout a full 360 degree rotation within a single plane 560 parallel to the transmit antenna plane 550.

Hub

Figure 10:
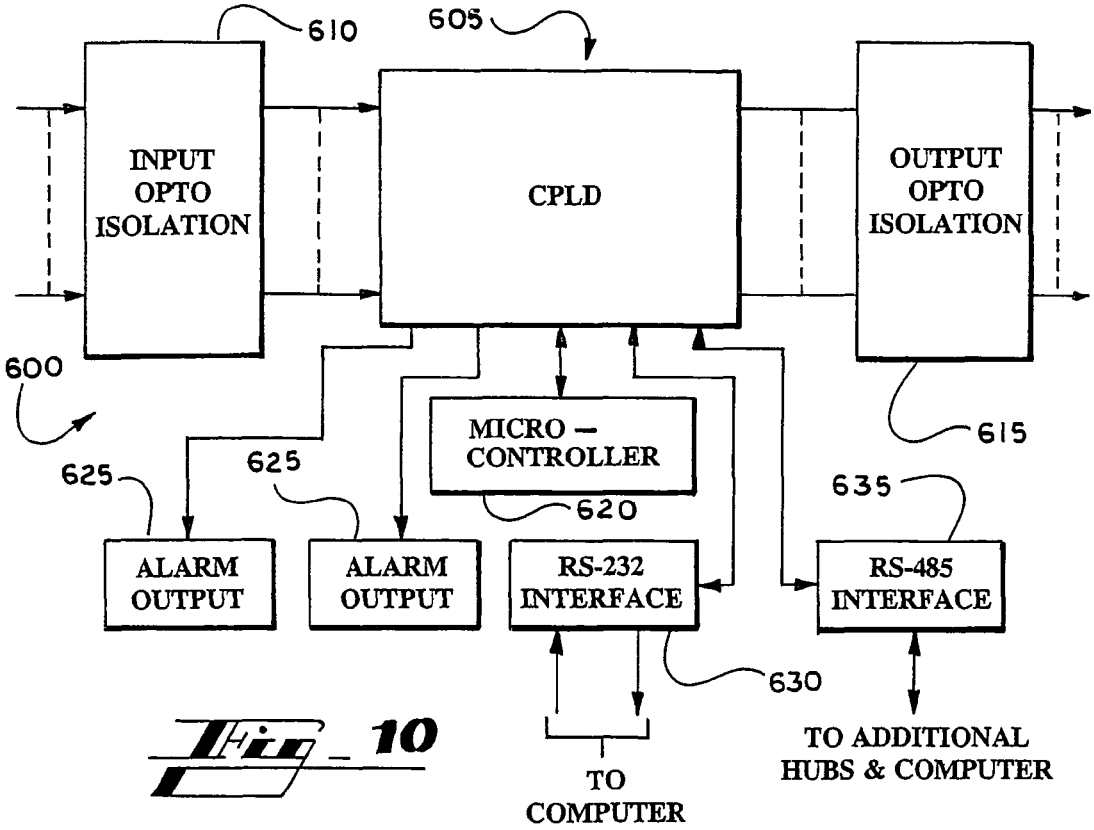
FIG. 10 illustrates a system block diagram of an embodiment of a hub.

FIG. 10 illustrates a system block diagram of an embodiment of a hub 600. As described above, the system 1000 further includes one or more data routers or hubs 600. The hubs 600 are used to collect all tag data not previously used or validated and concentrates the data received by the egress zones and distributed area receivers. In general, the hub 600 includes a complex programmable logic device ("CPLD") 605 connected to an input opto isolation module 610 and an output opto isolation module 615 as well as a microcontroller 620. In general, using the CPLD 605 in conjunction with the microcontroller 620, the hub 600 is able to operate even in the event of failure of the system 1000 computer 1500 connected to the hub 600. The CPLD 605 typically further includes one or more alarm outputs 625, a computer interface 630 and a hub interface 635 that allows the hub 600 to be interconnected to additional hubs in the system 1000. In one embodiment, the computer interface 630 is an RS-232 interface, although it is understood that the computer interface 630 can be a variety of other types of interfaces including but not limited to USB, GPIB and VME. In one embodiment, the hub interface 635 is an RS-485 interface, although it is understood that the hub interface 635 can be a variety of other types of interfaces such as but not limited to the interfaces listed above.

In general, the hub 600 collects all tag 100 data not previously used or validated, and concentrates data received by door zones and distributed area receivers and routes data to PC user interface/database. The hub 600 receives data from door zones and distributed area receivers that contains zone controller status and received tag data. The data is validated for proper timing and redundancy by the CPLD 605 and the hub microcontroller 620. The concentrated validated data is forwarded to the Computer through the RS-232 or RS-485 interface for display and logging, although it is understood that any form of human interface may be connected to these interfaces (i.e. Graphic Display Panel, Staff Alert Panel, etc.).

The hub can also implement a validate received tag 100 data method that validates and reports band alarms. The hub 600 reports and activates band alarms (band removal or band compromise) autonomously and independent of the computer 850. In the event that the computer is offline the alarm condition is still reported. The computer 850 can qualify band alarms for specific Tag IDs by a request for alarm code sent from the hub 600 to the computer 850 and a response sent from the computer 850 to the hub 600 either allowing or disallowing the alarm. There is an alarm activation default timeout if no response from the computer 850 is received. It is anticipated that other alarm conditions can be accommodated by this method. The hub 600 can report and activate band alarms (e.g., band removal or band compromise) autonomously and independent of the system computer 1500. Generally, band alarms for Tag ID can be qualified by the computer 1500. In addition, a band alarm activation default timeout is triggered in the hub 600 if there is no response from the computer 1500. The hub 600 can also anticipate other tag alarms.

The hub 600 can also implement band removal-band compromise alarm floor area and floor-to-floor tag ID discrimination methods that maintain alarm autonomy. The hub 600 can implement a series of methods that either allow the Tag ID range to be in the hub area or in computer 1500 area. In general, the tag ID range is the valid area table within the hub 600 and supplied by computer 1500. In one implementation, a default alarm can be triggered if the table is not setup or invalid. The computer 1500 can make a request from the hub 600 about the tag ID. In one implementation, a default alarm is triggered if there is no validating response from the computer 1500 after timeout. When tag 100 transmits alarm codes the RF transmitted data packets can be received on any receiver near enough to the tag 100 to receive an error free data packet, for example, receivers mounted in a stacked fashion on adjacent floors. Separate areas may be defined on each floor and a tag 100 reception from the wrong floor can cause a false alarm, an alarm for a Tag not in the area of interest. In one implementation, a tag ID range in the hub area are method sets a range of Tag ID numbers within the hub 600 that are defined as valid IDs for an alarm condition. Each hub 600 has to be wired to its own area. This method is inherently autonomous to the hub 600. In another implementation, a tag ID range in the computer area method sets a range of Tag ID numbers within the computer 1500 that are defined as valid IDs for an alarm condition. Each hub 600 has to be wired to its own area. This method is not autonomous to the hub 600. The computer 1500 reports the alarm and each area requires its own computer. In another implementation, a valid area table within the hub 600 supplied by a computer method maintains a set of Tag ID numbers within the hub 600 from a valid Tag ID table that is loaded by the computer 1500 that defines valid IDs for an alarm condition within an area. An alarm will default to valid if the table is not setup or correct. This method is inherently autonomous to the hub 600 during default. In still another implementation, a tag ID range in computer validating alarm requests from hub method requires the hub 600 to send an alarm request code to the computer 1500 for a certain tag ID. The computer 1500 sends a response to the hub 600 either allowing or disallowing the alarm. There is an alarm activation default timeout if no response from the computer 1500 is received. This method is inherently autonomous to the hub 600 during default.

The hub 600 can also implement a hub 600 supervision of the PC computer method through autonomous methods. After a lapse of supervision communication from the computer 1500, the hub 600 can activate an alarm or annunciator after sufficient timeout. It is important to have an independent means of verifying the proper function of the computer 1500 since it is displaying and logging the status of the overall system 1000. The hub 600 can activate an alarm or annunciator in the event of a lapse of supervision communication with the computer 1500 after timeout. In another implementation, there can also be computer 1500 supervision of the hub 600. The computer 1500 provides a means to supervise the entire system 1000. Since the hub 600 reports zone controller supervision codes (supervision of zone transmitter and receivers) and responds to supervision requests of the computer 1500 for first and multiple chained hubs the computer 1500 can make a determination of the health of the entire system 1000. The hub 600 can report controller supervision codes. The hub 600 can respond to supervision requests of the computer 1500. The computer 1500 generally supervises multiple chained hubs via supervision requests.

In another embodiment, the hub 600 can be an integral part of the zone controller, and zone and area receivers 1100, 1200.

Tag Activator/Deactivator

Figure 11:
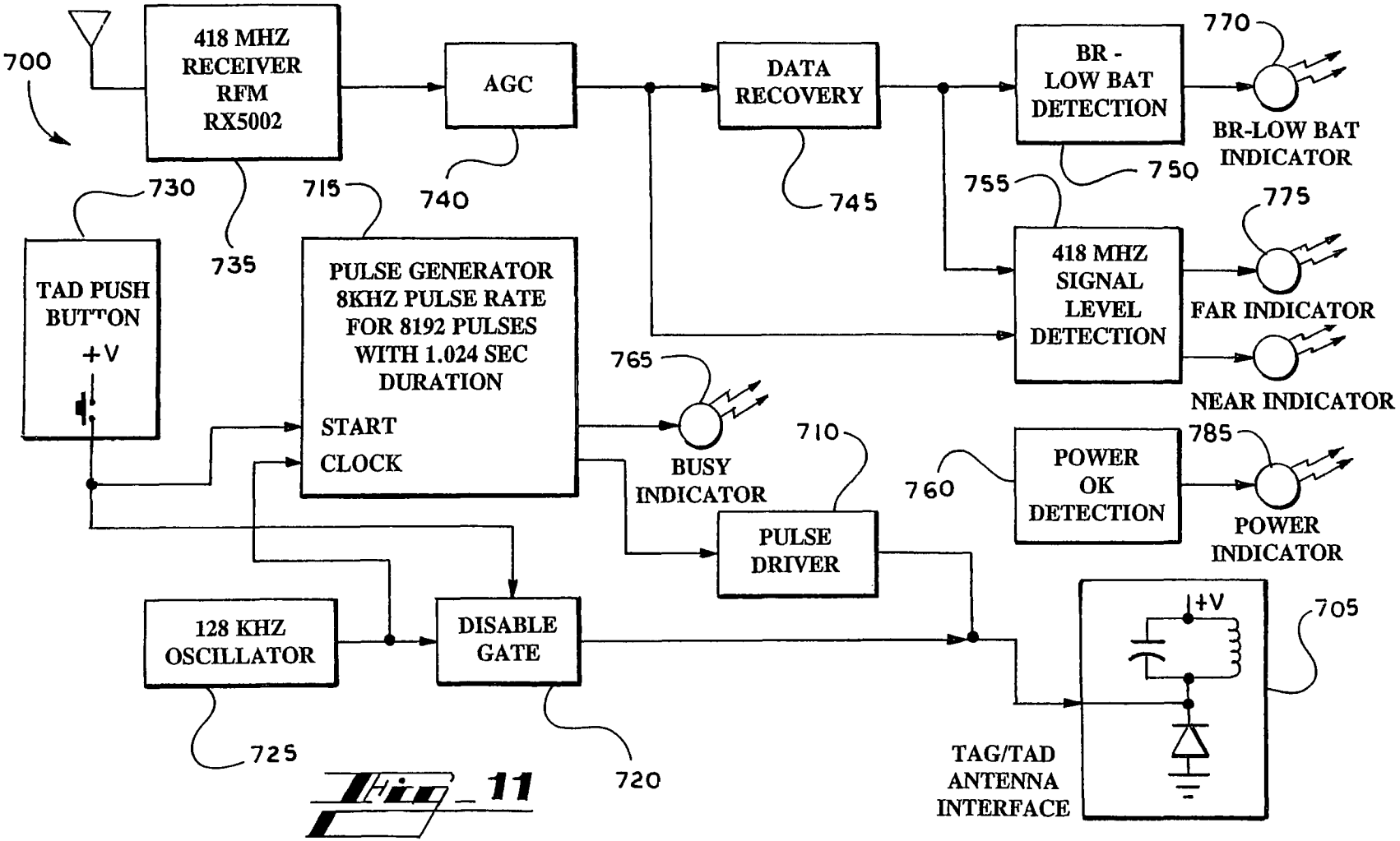
FIG. 11 illustrates a system block diagram of an embodiment of a tad.

FIG. 11 illustrates a system block diagram of an embodiment of a TAD 700. As described above, the TAD 700 is generally used to activate and deactivate the various tags in the system. The TAD 700 generally includes a tag/TAD interface 705 that is adapted to interface with the tag 100. In general, as described further below, the tag 100 interfaces with the TAD 700 through magnetic induction. The tag/TAD interface 705 is connected to a pulse driver 710 that is connected to a pulse generator 715. In general, the TAD 700 activates and deactivates the tag 100 through pulse programming via the magnetic induction. In one embodiment, the pulse generator 715 operates at a 8 kHz pulse rate for 8192 pulses with a 1.024 second duration. The tag/TAD interface 705 and the pulse generator 715 are connected to a disable gate module 720 that is connected to an oscillator 725, which can typically be 128 kHz. A push button module 730 is connected to the pulse generator 715 and to the disable gate module 720. In general, a user depresses the push button 730 when the tag 100 is interfaced with the TAD 700 to check the status of the tag 100. The TAD 700 further includes a receiver module 735 that can be a 418 MHz RFM RX5002 receiver. The receiver 735 is adapted to receive signals transmitted from the tag 100 in order to obtain the status of the tag 100. The receiver is connected to an automatic gain control (AGC) module 740 that is connected to a data recovery module 745 and to a signal level detection module 755. The data recovery module 745 is also connected to a band removal-low battery detection module 750. The TAD 700 further includes a series of indicators, which in one embodiment are light emitting diodes. When the push button 730 is depressed pulse generator 715 is started and busy indicator 765 is illuminated. Since the receiver 735 receives transmissions from the tag 100, the TAD 700 can typically indicate the proximity of the tag. A far indicator 775 illuminates when the tag 100 is in the area and a near indicator 780 illuminates if the tag 100 is very close to the TAD 700. In general, if these the near and far indicators 775, 780 illuminate when the tag 100 is near, then the tag 100 is activated. If the indicators 775, 780 do not illuminate when the tag 100 is near, then the tag 100 is deactivated. A band removal-low battery indicator 770 illuminates when the tag 100 has a low battery or is undergoing active band removal. In one implementation, to change the activated or deactivated state of the tag 100, the tag 100 is held at the interface 705 and the push button 730 is held depressed until the far, near indicators 775, 780 change state from on to off or off to on.

The TAD 700 is used as a diagnostic and activating tool in conjunction with a patient tag 100 within a patient abduction-egress prevention system. The TAD 700 unit has four basic modes of operation; 1) the device when coupled with a tag 100 and the push button 730 is pressed can turn on a tag 100 that is in its off state, 2) likewise a TAD 700 can turn off a tag 100 that is in its on state, 3) the unit while on and no push button 730 is pressed emits an 128 KHz field to simulate the field near an egress point providing a trigger source for tag 100 verification, and 4) the TAD 700 receives the 418 MHz alarm packets from the tag 100 under test and displays tag status on the indicators. The TAD 700 uses the 128 KHz oscillator 725 with low power drive of an inductor used as an antenna for the 128 KHz field.

In a typical embodiment, the TAD 700 uses 8 KHz pulses totaling 8192 for a duration 1.024 seconds to toggle the Tag on/off state. This use requires the tag 100 to be tightly coupled to the TAD 700 using the tag locator and proper orientation to function. The 128 KHz field of the TAD 700 activates a tag 100 within approximately 15 cm of the unit. The 418 MHz receiver is used to verify whether the tag 100 is on or off and the status of the tag 100 if on.

Generally, tag 100 activation/deactivation and data transfer methods are implemented via magnetic pulse coupling to the tag 100 received zone signal antenna inductor using signature pattern required by the tag 100. Use is initiated by the push button 730 or pattern of button pushes. By producing a large magnetic pulse in a coil in the interface 705 and coupling it to the received signal antenna inductor (see FIG. 13 below), a sufficient voltage is developed in the received signal inductor of the tag 100 to produce a program pulse. The tag software executes an activate-deactivate or power up/down command when sensing a signature pattern of programming pulses produced by the TAD 700. This is initiated by the push button 730. It is anticipated that this becomes a sequence of button pushes and that the signature pattern or data encoding may change.

The display of tag status (for example, band removal and low battery) is typically implemented through the indicators, and can include character information display and annunciators (audio or otherwise). In another embodiment, more complex tag communication via tag programming means can be implemented to control features and query complex status (i.e. battery capacity remaining). Furthermore, tag interactive means can be implemented using tag response supervision. In other embodiments, data coding and data rate alternatives can be implemented. The TAD 700 can typically take on the communication means of the tag programmer 800 allowing it to use the interactive tag response supervision to query complex status within the tag 100 and display it.

Tag Programmer

Figure 12:
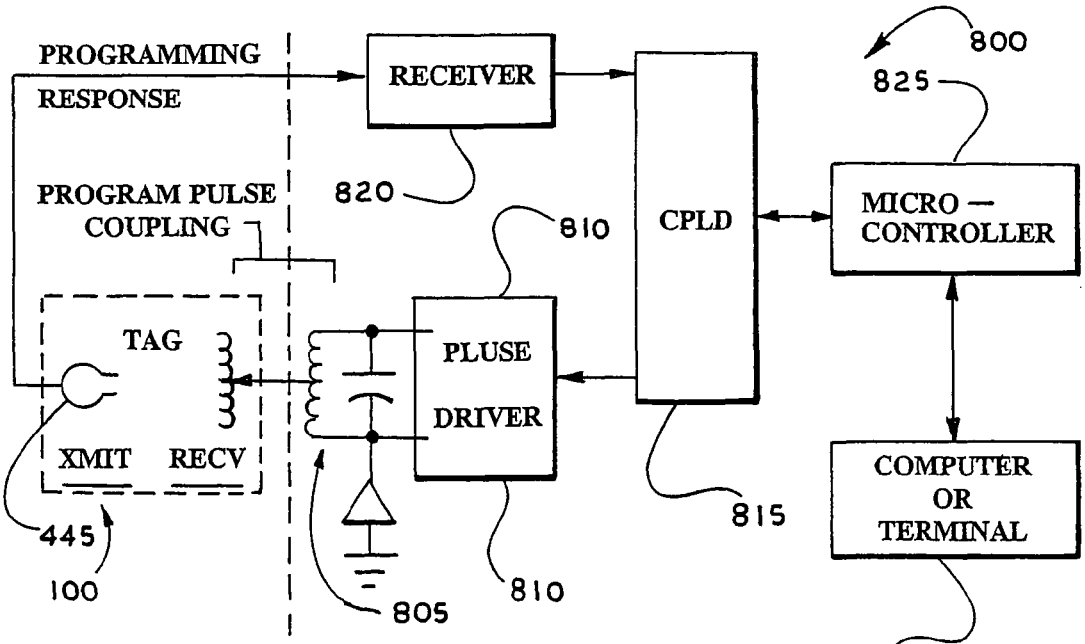
FIG. 12 illustrates a system block diagram of an embodiment of a tag programmer.

FIG. 12 illustrates a system block diagram of an embodiment of a tag programmer 800. As described above with respect to FIG. 1, the tag programmers 800 are used primarily to activate and deactivate tag features. In one embodiment, in general, programming of the tag 100, for the purpose of enabling or disabling of tag features, including tag ID number, power on/off and function selection is accomplished by the application of a high level programming pulses modulated by rate. This modulation is interpreted by the microprocessor within the tag for control of these features.

In general, the tag programmer 800 includes a program pulse coupling interface 805 that is connected to a pulse driver 820. The interface 805 is adapted to magnetically couple with the tag 100 through magnetic induction similar to the TAD interface 705. The tag 100 can in turn communicate with the tag programmer 800 through transmissions from its loop antenna 445. The tag programmer 800 receives the transmissions through its receiver 820 that is connected to a complex programmable logic device ("CPLD") 815. The pulse driver 810 is also connected to the CPLD 815. The CPLD 815 is connected to a microcontroller that is ultimately connected to the system 1000 computer 850. The computer 850 used in conjunction with the microcontroller 825 and CPLD 815 can be used to program the features of the tag 100 through the programming pulse method.

A tag activation/deactivation method via magnetic pulse coupling to tag 100 received zone signal antenna inductor is accomplished using signature pattern required by the tag 100 and EEPROM data memory access through programming access codes. The pulse driver 810 timing is achieved through the microcontroller 825. By producing a large magnetic pulse in a coil within program pulse coupling 805 and coupling it to the received signal antenna inductor (see FIG. 13 below), a sufficient voltage is developed in the received signal inductor of the tag to produce a program pulse. The pulse driver timing is controlled by the tag programmer microcontroller 825 and routed through the CPLD 815 to the pulse driver 810. Programming pulses at two different rates corresponding to ones and zeros allowing for tag data access of the internal EEPROM data memory of the tag microcontroller 400 through tag programming access codes (commands) and transfer of specific data to and from the tag EEPROM data memory used for parameters or feature control data are provided. This program pulse method allows for parameter access and function control after manufacture once the tag case is sealed closed. A number of parameters and control functions are accommodated and are previously described under the tag section.

The tag 100 response is received from tag transmitter 445 by the programmer receiver. Received data is typically validated through a validation process. Data packet decoding is also implemented. The tag 100 replies with data through the normal data packet transmission method used for tag ID and alarm code transmission. The tag programmer receiver 820 receives the tag-transmitted responses and the data is validated and decoded in the CPLD 815 and microcontroller 825.

Microcontroller timing of signature patterns and data-encoding is required by the tag 100. Tag programming access is typically accomplished through programming codes. The tag programmer microcontroller 825 typically produces the timing of the signature pattern and data encoding required by the tag 100. The tag 100 responds to programming access codes received as program pulses and decoded by the tag software.

The tag programmer 800 typically includes data formatting and user interface means to display and input tag 100 specific features, parameters, options, and data. A user interface whether a CRT terminal or computer is used to control the tag programmer 800. It is the vehicle to supply the data to input Tag ID, control certain features, change parameters, options, and data. The display is used to display the status and data contained within the tag 100 and extracted via the programming access codes and resulting tag responses.

Figure 13:
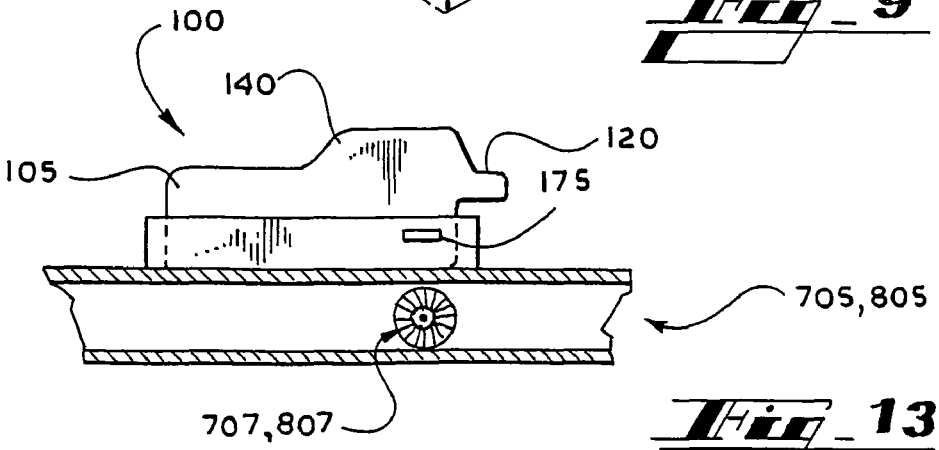
FIG. 13 illustrates a side view of an interface between the tag and either of the TAD or tag programmer.

FIG. 13 illustrates a side view of an interface between the tag 100 and either of the TAD 700 or tag programmer 800. The interfaces 705, 805 as described above communicate with the tag 100 through magnetic induction, specifically the programming pulse method. The tag 100 further includes an internal tag receive antenna inductor 175 coupled to the internal circuitry of the tag 100. The TAD 700 and tag programmer 800 further includes a programming pulse coil 707, 807 in their respective interfaces 705, 805. The tag receive antenna inductor 175 and the programming pulse coil 707, 807 form a magnetic inductive circuit through which the programming pulse communication can occur.

The software techniques and methods discussed above can be implemented in digital electronic circuitry, or in computer hardware, firmware (as discussed), software, or in combinations of them. Apparatus may be implemented in a computer program product tangibly embodied in a machine-readable storage device for execution by a programmable processor; and methods may be performed by a programmable processor executing a program of instructions to perform functions by operating on input data and generating output. Further embodiments may advantageously be implemented in one or more computer programs that are executable on a programmable system including at least one programmable processor coupled to receive data and instructions from, and transmit data and instructions, to a data storage system, at least one input device, and at least one output device. Each computer program may be implemented in a high level procedural or object-oriented programming language, or in assembly or machine language, which can be compiled or interpreted. Suitable processors include, by way of example, both general and special purpose microprocessors. Generally, a processor receives instructions and data from read-only memory and or RAM. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing may be supplemented by, or incorporated in, specially designed application specific integrated circuits (ASICs).

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A security system, comprising:

a security tag, said tag comprising firmware, a circuit, a transmitter, a housing, a connecting band and a receiver, wherein said housing comprises external conductive contacts, said housing further comprises a front end, a rear end, a lower surface, an upper surface, a slot defined along a length of said rear end, parallel raised walls located proximate said rear end, adjacent and generally perpendicular to said slot, and a cam lock pivotally connected to and between said walls, and wherein said cam lock further comprises parallel ridged surfaces, said housing further comprises a ridged surface located between said conductive contacts, and wherein said connecting band extends through said slot, defining a loop proximate said cam lock and said rigid surfaces thereof, wherein said housing further comprises a plurality of female recesses, and said cam lock further comprises male tabs, said male tabs dimensioned to mate and snap into said female recesses;

an activator/deactivator unit, a tag programmer, external to, inductively coupled and operatively linked to said security tag and adapted to update and change said firmware; and a hub operatively connected to at least one said security tag, receiving data therefrom.

2. The security system of claim 1, wherein said connecting band, further elongated contacts disposed to interface with said external contact of said housing.

3. The security system of claim 2, wherein said connecting band is in an interleaved engagement with said housing of said security tag, and wherein said band is coupled to said external conductive contacts and said circuit of said housing.

4. The security system of claim 2, wherein said elongated contacts of said connecting band are positioned along the length of said connect band in a generally parallel orientation.

5. The security system of claim 2, wherein said connecting band is elastic.

6. The security system of claim 2, wherein said elongated contacts of said connecting band are adapted to substantially surround an individual's limb.

7. The security system of claim 2, wherein said external conductive contacts of said housing are coupled to said circuit of said housing.

8. The security system of claim 2, wherein said elongated contacts of said connecting band are each a first plate in an impedance circuit.

9. The security system of claim 8, further comprising a pseudo plate corresponding to each of said first plates having a dielectric material formed by the epidermal layer of the limb, said dielectric material located between said first plates and said pseudo plates.

10. The security system of claim 9, further comprising a conductive path located between at least one of said elongated contacts of said connecting band and at least one said pseudo plate.

11. The security system of claim 2, further comprising a microprocessor coupled to said circuit of said housing, wherein said microprocessor receives pulse programming via inductive coupling from said tag programmer.

12. The security system of claim 11, wherein said pulse programming comprises instructions selected from a group of tag features and parameters comprising: modifying a band removal skin sense parameter, modifying a band compromise sense parameter, modifying filter parameters, modifying a low battery indication calibration parameter, modifying number of transmissions indicating the end of a battery life, retrieving transmission count, modifying tag loiter transmission management feature parameters, modifying microcontroller internal oscillator calibration parameter, modifying transmission counts before sleep and zone field qualification, selection of band removal-band compromise code reporting method, modifying tag type operation and modifying and retrieving features, parameters, options and data including QC information, calibration information, warranty information and descriptive comment space.

13. The security system of claim 2, wherein said circuit of said housing is adapted to receive a first signal and to transmit a second signal based upon a qualification of said first signal.

14. The security system of claim 2, wherein said connecting band is woven, and wherein said elongated contacts of said band are integral, woven fibers.

15. The security system of claim 2, wherein said housing is sealed.

16. The security system of claim 2, wherein said elongated contacts have insulation suitable for removing a direct current (DC) resistance circuit path from skin contact.

17. The security system of claim 2, wherein said connecting band is a non-porous elastomer, and wherein said elongated contacts of said band are integral, elastomeric conductors.

18. The security system of claim 1, further comprising a low current wake-up circuit portion for waking up a microprocessor, independent from a wake-up circuit on-board said microprocessor.

19. The security system of claim 1, wherein said circuit further comprises a band sense circuit portion, and wherein said band sense circuit measures skin impedance.

20. The security system of claim 1, further comprising a phased, multiple element antenna, said antenna sending signals to said security tag.

21. The security system of claim 20, wherein said phased, multiple element antenna further comprises at least two phased antenna elements in a spatially oriented configuration in an antenna plane and at least two independently phased continuous excitation sources coupled to each of said phased antenna elements, and wherein said phased antenna elements are arranged orthogonally.

22. The security system of claim 21, wherein said spatially oriented configuration includes a resultant magnetic vector within a defined tag activation zone.

23. The security system of claim 22, wherein said tag activation zone is defined by a uniform strength received signal at said security tag throughout a 360-degree rotation within a single tag plane, defined generally parallel to the plane of said antenna.

24. The security system of claim 1, wherein said hub further comprises a microcontroller adapted to process information related to said security tag, said information comprising instructions to qualify band alarms for tag identification.

25. The security system of claim 24, wherein said instructions to qualify band alarms comprise data by a request for an alarm code sent from said hub to a computer, and a response sent from said computer to said hub.

26. The security system of claim 1, wherein said hub further comprises a microcontroller adapted to process information related to autonomously supervising a computer, said information having instructions to alarm or annunciate if a supervise code is sent from said hub to said computer and a response sent from said computer to said hub is not received after a timeout.

27. The security system of claim 1, wherein said security tag further comprises a microprocessor and said tag programmer further comprises a receiver adapted to receive transmissions from said security tag, a program pulse coupling forming part of a mutually coupled inductive circuit, the other part of said inductive circuit being located on said security tag, and a microcontroller, said microcontroller coupled to said receiver of said tag programmer and said program pulse coupling, said microcontroller adapted to process instructions received and adapted to set features and parameters in said security tag.

28. The security system of claim 1, wherein said activator/deactivator unit further comprises a tag inductive interface coil forming a part of a mutually coupled inductive circuit, the other part being located with said security tag, a receiver adapted to receive signals from said transmitter of said security tag, first circuitry to detect the proximity of said security tag relative to said activator/deactivator unit, and second circuitry to detect connecting band removal or low batter condition, said first and said second circuitry connected to said receiver of said activator/deactivator unit.

29. The security system of claim 28, further comprising an oscillator connected to said tag inductive interface coil and functioning as an antenna in creation of a tag activation field.

* * * * *